US006135260A

United States Patent [19]

Schwarzli

[11] Patent Number: 6,135,260

[45] Date of Patent: Oct. 24, 2000

[54] BRAKING SYSTEM FOR ROTARY COIN MECHANISM

[75] Inventor: Josef W. Schwarzli, Stouffville, Canada

[73] Assignee: Machine-O-Matic Limited, Newmarket, Canada

[21] Appl. No.: 09/175,943

[22] Filed: Oct. 21, 1998

[30] Foreign Application Priority Data

Nov. 19, 1997 [CA] Canada ..... 2221766

[51] Int. Cl.[7] ..... G07F 5/02

[52] U.S. Cl. ..... 194/255; 194/292; 221/15; 222/477

[58] Field of Search ..... 194/255, 292, 194/236, 237; 221/15, 16; 222/477

[56] References Cited

U.S. PATENT DOCUMENTS 1,764,091 6/1930 Wurzbach et al. ..... 194/255

*Primary Examiner*—Robert P. Olszewski
*Assistant Examiner*—Bryan Jaketic
*Attorney, Agent, or Firm*—Dimock Stratton Clarizio; Mark B. Eisen

[57] ABSTRACT

A rotary coin mechanism is provided with a braking system in which one end of a stationary brake arm is anchored to the frame of the mechanism. The other end of the brake arm provides a breaking ring which surrounds the hub of the drive gear and applies a compressive force thereto, to frictionally restrain the drive gear and thus prevent the coin mechanism from free-wheeling rotation. In the preferred embodiment the braking ring is open at one end and merges into a bifurcated stem which provides an adjusting screw to adjust the compressive force applied by the braking ring.

21 Claims, 4 Drawing Sheets

FIG. 4.
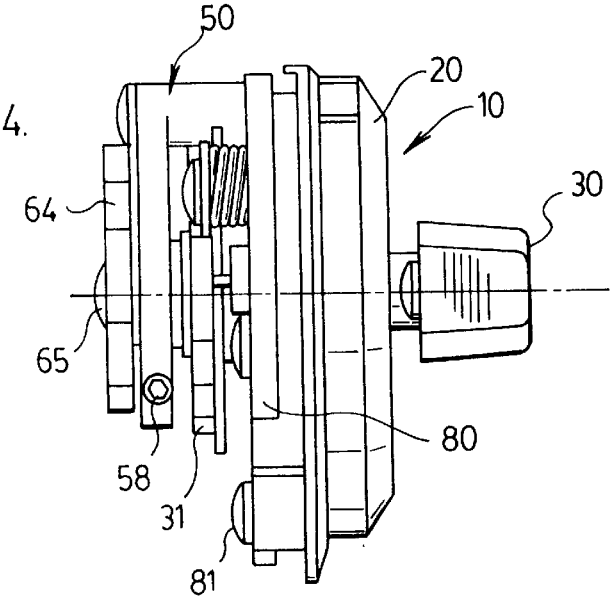
FIG. 5.
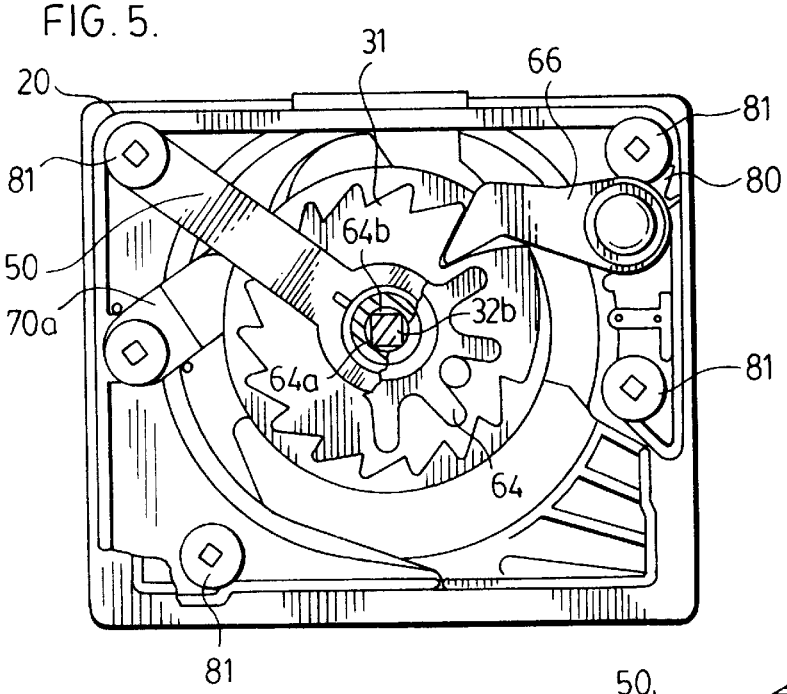
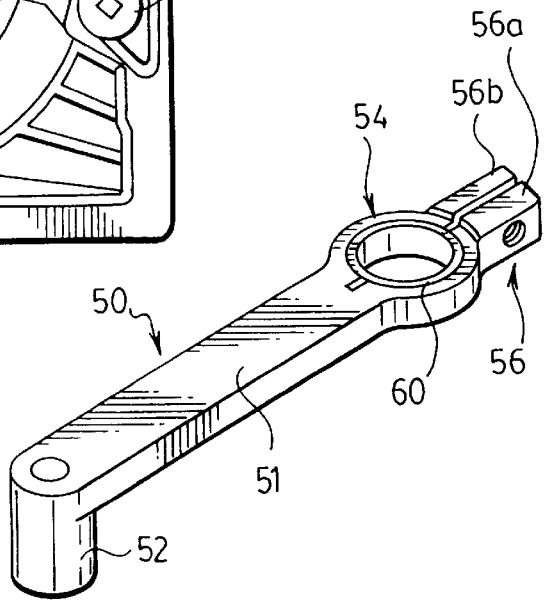
FIG. 6.

BRAKING SYSTEM FOR ROTARY COIN MECHANISM

FIELD OF INVENTION

This invention relates to coin mechanisms for vending machines. In particular, this invention relates to a rotary coin mechanism for a bulk vender or other apparatus, having a braking system that prevents the mechanism from being turning too quickly.

BACKGROUND OF THE INVENTION

Rotary coin mechanisms are widely used in merchandise-dispensing machines such as bulk venders for dispensing gumballs and other small articles, such as confectioneries, toys, cigarettes etc.

A bulk vender typically dispenses articles stored in a transparent globe or product bin through a dispensing wheel at the base of the bin. The dispensing wheel comprises a plurality of product compartments into which one or more of the stored articles fall. A rotary coin mechanism is provided with a drive gear that meshes with a toothed edge of the dispensing wheel, so that when a user deposits the required coinage into the coin mechanism and turns the handle the drive gear rotates the dispensing wheel. As the dispensing wheel rotates one of the product compartments moves under a shroud or hood which isolates it from the product bin, and a dispensing opening in the floor of the isolated product compartment comes into alignment with the opening to a dispensing chute. The articles contained in the isolated product compartment fall through the dispensing chute and are thereby dispensed to the user. The next time the dispensing wheel is rotated to dispense merchandise, the isolated product compartment rotates out from under the hood and is re-exposed to articles in the product bin, and is thus refilled with articles that randomly drop into the product compartment.

Bulk venders can dispense many different types of merchandise of varying sizes and shapes. Typically the vender is stocked with a specific type of merchandise. Depending upon the value of the merchandise and the coinage required by the vender, in some case a single article is intended to be vended with each rotation of the handle, in which case the size of the product compartments can be adjusted to accept only a single article, while in other cases multiple articles are intended to be vended with each rotation of the handle, and the size of the product compartments is adjusted accordingly. However, many vendable articles are not spherical and do not readily fall into a product compartment as the dispensing wheel rotates; in such cases the vender relies on agitators disposed within the product bin and relatively prolonged exposure to articles in the product bin to ensure that each product compartment is filled to capacity by the time it comes into alignment with the dispensing chute to dispense merchandise to a user.

This presents a problem if the handle of the coin mechanism is turned too quickly by a user. Especially in the case of oddly shaped or oblong articles, such as certain types of confectionaries, cigarettes etc., when the coin mechanism is turned too quickly by the user the product compartments may not be exposed to the product bin for a sufficient time to ensure that each product compartment is filled to capacity by the time it comes into alignment with the dispensing chute. Thus, a user turning the coin mechanism too quickly may obtain their merchandise from the product compartment which next comes into alignment with the dispensing chute, but a subsequent user may find that there is no merchandise dispensed by the vender, or less than the intended number of articles, because a subsequent product compartment has not had an adequate opportunity to fill with articles from the product bin due to the overzealousness of a previous user. This presents an obvious problem for the user who deposits a coin and does not receive adequate merchandise from the vendor, but it also presents a problem for the vender operator who may be called upon unnecessarily to make repairs to a perfectly operable vender, or who may lose the future business of dissatisfied patrons who come to distrust the reliability of bulk venders.

The present invention overcomes this problem by providing a coin mechanism for a bulk vender which provides a braking system which restrains the coin mechanism against free-wheeling rotation and thus ensures a relatively prolonged exposure of each product compartment to the product bin during use of the vender, reducing opportunities for a product compartment to cycle through the product bin without filling to capacity with merchandise.

The invention accomplishes this by providing a brake arm anchored to the frame of the coin mechanism at one end and having a braking ring at the other end which engages a component on the shaft, preferably the hub of the dispensing gear, providing a selected degree of resistance against rotation of the handle and thus preventing the handle from being turned too quickly by a user. The braking ring is adjustable, so that the compression of the braking ring on the dispensing gear hub can be adjusted to suit the size and shape of articles stored in the product bin.

The present invention thus provides a coin mechanism comprising a frame comprising a cover plate having a coin opening, a handle fixed to a shaft extending through the cover plate, a coin conveyor comprising a coin receiving portion, rotationally engaged to the shaft such that the coin receiving portion is in substantial alignment with the coin opening when the coin conveyor is in a rest position, a drive gear rotationally fixed to the shaft, and a brake arm anchored to the frame comprising a braking ring surrounding the shaft and applying a compressive force to the shaft or to a component rotationally fixed to the shaft, whereby the compressive force of the braking ring restrains the shaft against free-wheeling rotation.

The present invention further provides an apparatus for dispensing merchandise having a coin mechanism comprising a frame comprising a cover plate having a coin opening, a handle fixed to a shaft extending through the cover plate, a coin conveyor comprising a coin receiving portion, rotationally engaged to the shaft such that the coin receiving portion is in substantial alignment with the coin opening when the coin conveyor is in a rest position, a drive gear rotationally fixed to the shaft, and a brake arm anchored to the frame comprising a braking ring surrounding the shaft and applying a compressive force to the shaft or to a component rotationally fixed to the shaft, whereby the compressive force of the braking ring restrains the shaft against free-wheeling rotation.

The present invention further provides an apparatus for dispensing merchandise comprising a housing, a product storage bin for storing merchandise mounted above the housing, a dispensing wheel disposed between the product bin and the housing to convey one of a plurality of product compartments into alignment with an opening to a dispensing chute, and a coin mechanism mounted in the lower housing comprising a frame comprising a cover plate having a coin opening, a handle fixed to a shaft extending through the cover plate, a coin conveyor comprising a coin receiving portion, rotationally engaged to the shaft such that the coin receiving portion is in substantial alignment with the coin opening when the coin conveyor is in a rest position, a drive gear rotationally fixed to the shaft for rotating the dispensing wheel, and a brake arm anchored to the frame comprising a braking ring surrounding the shaft and applying a compressive force to the shaft or to a component rotationally fixed to the shaft, whereby the compressive force of the braking ring restrains the shaft against free-wheeling rotation.

BRIEF DESCRIPTION OF THE DRAWINGS

In drawings which illustrate by way of example only a preferred embodiment of the invention, FIG. 4 is a side elevation of the coin mechanism of FIG. 2, FIG. 5 is a rear elevation of the coin mechanism of FIG. 2, FIG. 6 is a perspective view of a preferred embodiment of the brake arm in the coin mechanism of FIG. 2.

DETAILED DESCRIPTION OF THE INVENTION

Figure 1:
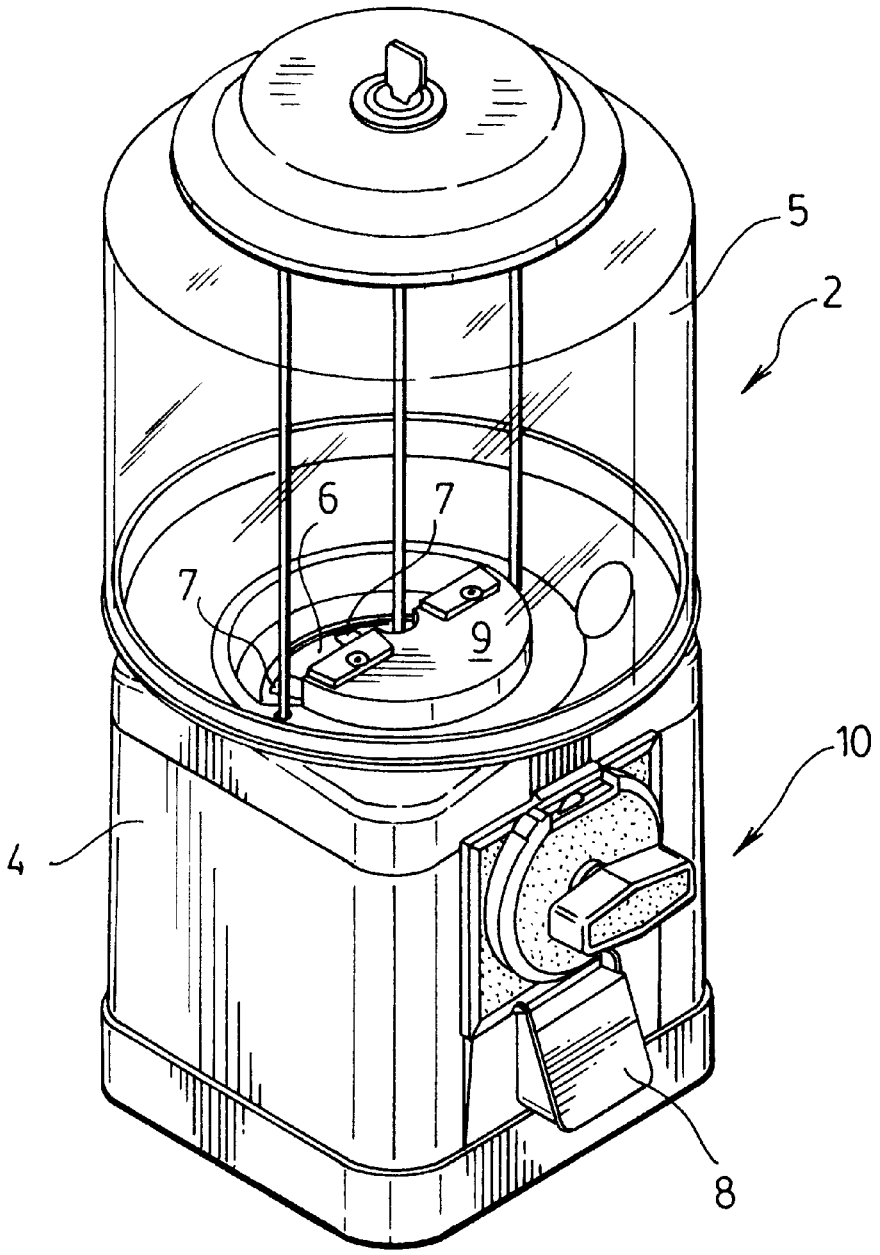
FIG. 1 is a front perspective view of a bulk vender.
Figure 2:
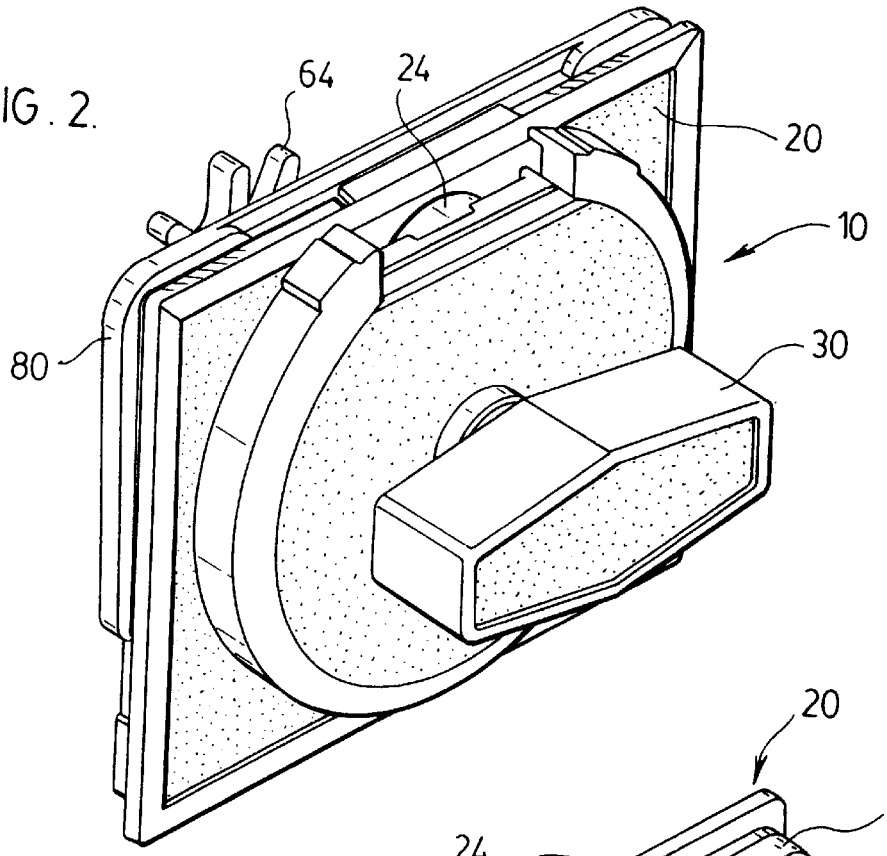
FIG. 2 is a front perspective view of a coin mechanism embodying the invention.
Figure 3:
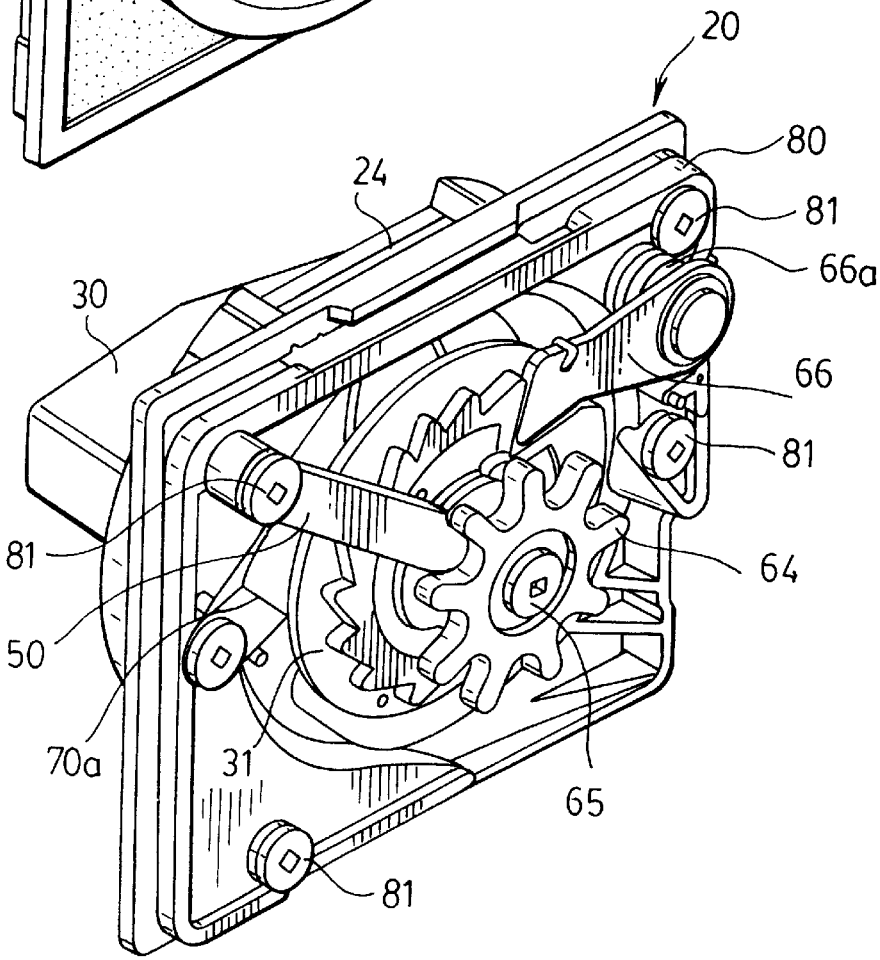
FIG. 3 is a rear perspective view of the coin mechanism of FIG. 2.
Figure 7:
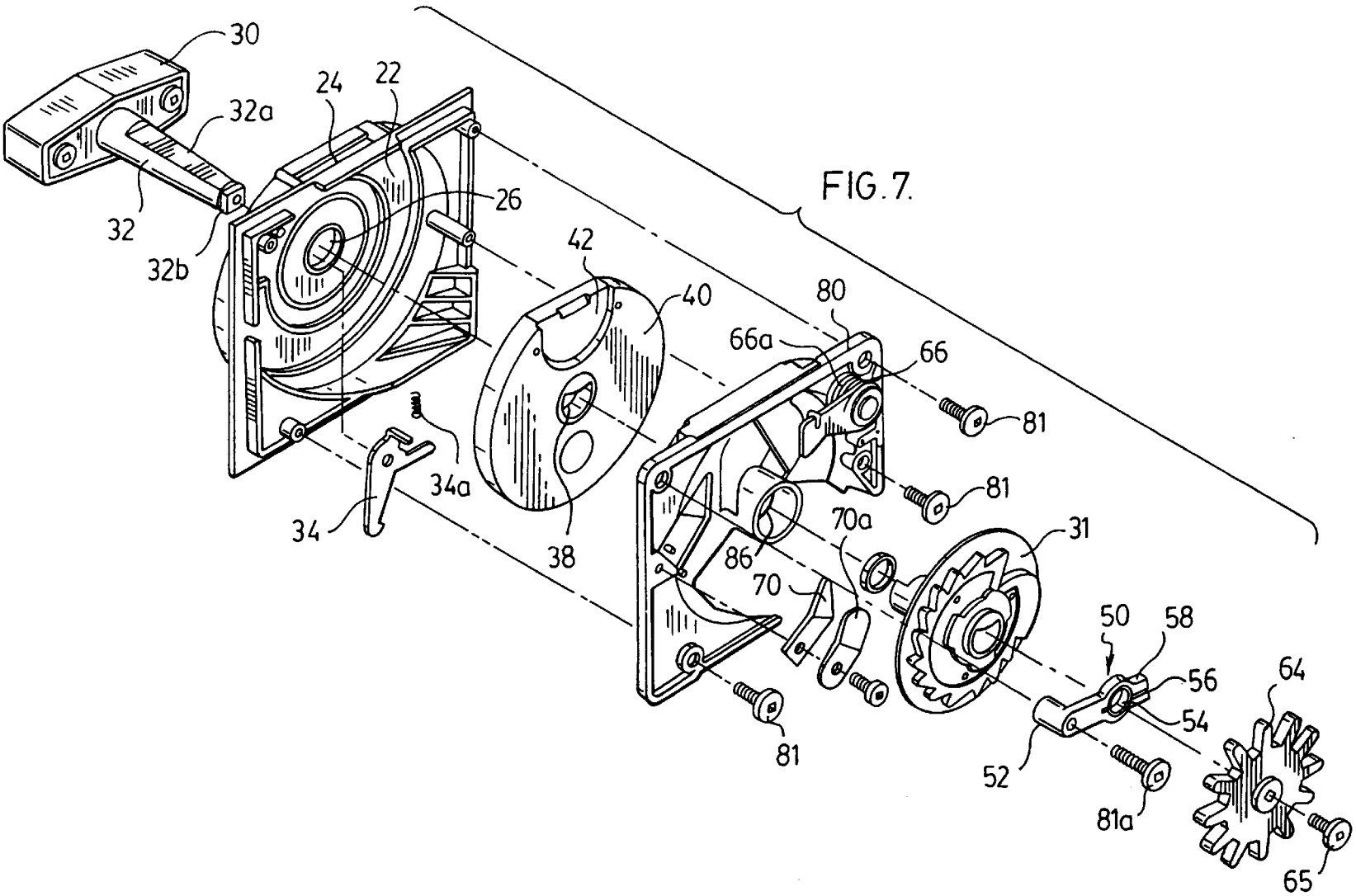
FIG. 7 is an exploded perspective view of the coin mechanism of FIG. 2.

FIG. 1 illustrates a merchandise-dispensing apparatus commonly known as a bulk vender 2 in which the coin mechanism 10 of the invention may be employed. The vender 2 conventionally includes a lower housing 4 enclosing the workings of the coin mechanism 10 and a cash box (not shown) for collecting deposited coins or tokens, a transparent product storage bin 5 for storing merchandise such as gumballs, confectioneries, toys etc. to be dispensed, and a dispensing wheel 6 which is rotated by rotation of the coin mechanism 10 to convey one of a plurality of product compartments 7 beneath a shroud or hood 9 and align an opening (not shown) in the floor of the product compartment 7 with the opening to a dispensing chute 8, as is well known.

FIGS. 2 to 7 illustrate a preferred embodiment of the coin mechanism 10 of the invention. The mechanism 10 comprises a cover plate 20 having a coin opening 24, a circular recess 22 in its rear face (seen in FIG. 7) in which a substantially disc-shaped coin conveyor 40 rotates, and an opening 26 centred in the recess 22. The handle 30 is fixed to a tapered shaft 32 which extends through the opening 26 and engages an opening 38 disposed through the centre of the coin conveyor 40. The shaft 32 has a longitudinal flat (or slightly concave) surface 32*a* to rotationally engage the various components engaged to the shaft 32.

The coin conveyor 40 includes a coin receiving portion for receiving a coin (not shown), which in the preferred embodiment comprises a suitably dimensioned recess 42 in which the coin nests as it is conveyed about the rotational cycle of the coin mechanism 10. A back plate 80 overlays the coin conveyor 40 and is affixed to the cover plate 20 so as to be stationary relative thereto, as by bolts 81. The back plate 80 retains a coin in the coin recess 42 along the rotational path followed by the coin as the mechanism 10 is rotated. The shaft 32 extends through the opening 86 in the back plate 80, through a ratchet gear 31 which cooperates with a pawl 66 biased against the gear 31 by a spring 66*a* to prevent reverse rotation of the mechanism 10 during most of the rotational cycle, and terminates at a squared end 32*b* to which the drive gear 64 for rotating the dispensing wheel 6 is engaged by a bolt 65. The drive gear 64 preferably has a hub 64*b* with a square recess 64*a* which rotationally fixes the drive gear 64 to the squared end 32*b* of the shaft 32. Thus, the frame of the coin mechanism 10 comprises a cover plate 20 and a back plate 80 which remain stationary, while the coin conveyor 40 and drive gear 64 are fixed in position on the shaft 32 and rotate as the handle 30 is turned.

Typically a dog 70 for measuring the thickness of a coin is mounted on the back plate 80 biased against the coin recess 42 by a spring 70*a*, to catch the trailing edge of the coin recess 42 if an inserted coin or slug is thinner than the intended coin, to arrest rotation of the mechanism 10, and another dog 34 for measuring the diameter of the coin is mounted on the cover plate 20 biased against the coin conveyor 40 by a spring 34*a*, to catch a detent (not shown) formed in the front face of the coin conveyor 40 if an inserted coin or slug does not have the correct diameter and arrest rotation of the mechanism 10.

The present invention provides a braking system for preventing free-wheeling rotation of the mechanism 10 and thus preventing the mechanism 10 from being turned at an excessive rate.

The invention comprises a brake arm 50, illustrated in FIG. 6, anchored at an anchoring end 52 to the frame of the coin mechanism 10 as by a bolt 81*a*. The other end of the brake arm 50 is provided with a braking ring 54 which surrounds the shaft 32 and applies a compressive force either to the shaft 32 itself or to a component rotatably fixed to the shaft 32. Preferably the braking ring 54 is adapted to compressively engage the hub 64*b* of the drive gear 64, which is typically long enough to accommodate a brake arm 50 of the required thickness, and thus the braking ring 54 is provided with a diameter slightly larger than the diameter of the hub 64*b*.

In the preferred embodiment the braking ring 54 is provided with a break opposite the shank 51 of the brake arm 50 and merges into in a bifurcated stem 56. A tightening member such as a screw 58 extends between the prongs 56*a*, 56*b* of the stem 56 for adjustably fixing the prongs 56*a*, 56*b* in spaced apart relation. The screw 58 extends through one prong 56*a* and is threadedly received by the other prong 56*b*. Thus, tightening the screw 58 draws the prongs 56*a*, 56*b* together, reducing the effective diameter of the braking ring 54 and commensurately increasing the compressive force applied by the braking ring 54 to the hub 64*b* of the drive gear 64. If desired the bifurcation may continue slightly past the braking ring 54 into the shank 51 of the brake arm 50 as shown, to reduce the strain on the braking ring 54, however bifurcation of the shank 51 should be minimal so as not to unduly reduce the compressive capacity of the braking ring 54.

The brake arm 50 is preferably composed of a relatively resilient metal, and a nylon or other suitable bushing 60 is provided in the braking ring 54 to prevent undue abrasion between the ring 54 and the hub 64*b*. The brake arm 50 may alternatively be composed of a suitably rigid and durable plastic, in which case the bushing 60 may be unnecessary.

In operation, when a coin is deposited through the coin opening 24, the coin nests in the coin recess 42 of the coin conveyor 40. As the handle 30 is turned the coin conveyor 40 conveys the coin past the measuring dogs 34, 70, which measure the coin to ensure that it is of the correct diameter and thickness. If the coin is of the intended denomination, the measuring dogs 34, 70 will allow the mechanism 10 to be rotated through the dispensing cycle. As the handle 30 is turned the drive gear 64 rotates the dispensing wheel 6 so that an opening in the floor of a product compartment 7 comes into alignment with the dispensing chute 8 and dispenses merchandise to the user.

Throughout the rotational cycle of the coin mechanism 10 the braking ring 54 applies a compressive force against the hub 64*b* of the drive gear 64, which restrains the drive gear 64, and thus the shaft 32 and handle 30, against free-wheeling rotation to prevent the coin mechanism 10 from being turned too quickly by the user.

The extent to which the braking ring 54 restrains the drive gear 64 is determined by the adjusting screw 58. To increase frictional resistance and slow down rotation of the coin mechanism 10 the screw 58 is tightened, drawing the prongs 56*a*, 56*b* closer together and increasing the compressive force of the braking ring 54 against the hub 64*b* of the drive gear 64. To decrease frictional resistance and allow faster rotation of the coin mechanism 10 the screw 58 is loosened, allowing the prongs 56*a*, 56*b* to spread apart and decreasing the compressive force of the braking ring 54 against the hub 64*b* of the drive gear 64. The degree of compression applied by the braking ring 54 to the hub 64*a* is adjusted to suit the size and shape of the articles in the product storage bin 5, to ensure that each product compartment 7 is allowed a sufficiently prolonged exposure to the product bin 5 that every product compartment 7 fills to capacity with merchandise as the dispensing wheel 6 rotates during use of the vender 2.

The invention having been thus described with reference to a preferred embodiment, it will be apparent to those skilled in the art that variations and modifications of the invention may be made without departing from the scope of the invention, as set out in the appended claims.

I claim:

1. A coin mechanism comprising a frame comprising a cover plate having a coin opening, a handle fixed to a shaft extending through the cover plate, a coin conveyor comprising a coin receiving portion, rotationally engaged to the shaft such that the coin receiving portion is in substantial alignment with the coin opening when the coin conveyor is in a rest position, a drive gear rotationally fixed to the shaft, and a brake arm anchored to the frame comprising a braking ring surrounding the shaft and applying a compressive force to the shaft or to a component rotationally fixed to the shaft, whereby the compressive force of the braking ring restrains the shaft against free-wheeling rotation.

2. The mechanism of claim 1 in which the braking ring is mounted about a hub of a dispensing gear.

3. The mechanism of claim 1 in which the braking ring has an opening at one end and merges into a bifurcated stem of the brake arm.

4. The mechanism of claim 3 in which an adjusting member extends between a pair of prongs comprised in the stem, such that the adjusting member fixes the prongs to a preselected spaced apart relation.

5. The mechanism of claim 4 in which the adjusting member is a screw threadedly received by one of the prongs.

6. The mechanism of claim 1 in which the braking ring contains a bushing.

7. The mechanism of claim 3 in which the bifurcation extends into a shank of the brake arm.

8. An apparatus for dispensing merchandise having a coin mechanism comprising a frame comprising a cover plate having a coin opening, a handle fixed to a shaft extending through the cover plate, a coin conveyor comprising a coin receiving portion, rotationally engaged to the shaft such that the coin receiving portion is in substantial alignment with the coin opening when the coin conveyor is in a rest position, a drive gear rotationally fixed to the shaft, and a brake arm anchored to the frame comprising a braking ring surrounding the shaft and applying a compressive force to the shaft or to a component rotationally fixed to the shaft, whereby the compressive force of the braking ring restrains the shaft against free-wheeling rotation.

9. The mechanism of claim 8 in which the braking ring is mounted about a hub of a dispensing gear.

10. The mechanism of claim 8 in which the braking ring has an opening at one end and merges into a bifurcated stem of the brake arm.

11. The mechanism of claim 10 in which an adjusting member extends between a pair of prongs comprised in the stem, such that the adjusting member fixes the prongs to a preselected spaced apart relation.

12. The mechanism of claim 11 in which the adjusting member is a screw threadedly received by one of the prongs.

13. The mechanism of claim 8 in which the braking ring contains a bushing.

14. The mechanism of claim 10 in which the bifurcation extends into a shank of the brake arm.

15. An apparatus for dispensing merchandise comprising a housing, a product storage bin for storing merchandise mounted above the housing, a dispensing wheel disposed between the product bin and the housing to convey one of a plurality of product compartments into alignment with an opening to a dispensing chute, and a coin mechanism mounted in the lower housing comprising a frame comprising a cover plate having a coin opening, a handle fixed to a shaft extending through the cover plate, a coin conveyor comprising a coin receiving portion, rotationally engaged to the shaft such that the coin receiving portion is in substantial alignment with the coin opening when the coin conveyor is in a rest position, a drive gear rotationally fixed to the shaft for rotating the dispensing wheel, and a brake arm anchored to the frame comprising a braking ring surrounding the shaft and applying a compressive force to the shaft or to a component rotationally fixed to the shaft, whereby the compressive force of the braking ring restrains the shaft against free-wheeling rotation.

16. The mechanism of claim 15 in which the braking ring is mounted about a hub of a dispensing gear.

17. The mechanism of claim 15 in which the braking ring has an opening at one end and merges into a bifurcated stem of the brake arm.

18. The mechanism of claim 17 in which an adjusting member extends between a pair of prongs comprised in the stem, such that the adjusting member fixes the prongs to a preselected spaced apart relation.

19. The mechanism of claim 18 in which the adjusting member is a screw threadedly received by one of the prongs.

20. The mechanism of claim 15 in which the braking ring contains a bushing.

21. The mechanism of claim 17 in which the bifurcation extends into a shank of the brake arm.

* * * * *